US005689964A

United States Patent [19]

Kawakita et al.

[11] Patent Number: 5,689,964

[45] Date of Patent: Nov. 25, 1997

[54] OPERATION CONTROL DEVICE FOR AIR CONDITIONER

[75] Inventors: Hiroyuki Kawakita; Satoshi Takagi; Hideki Tsutsumi, all of Osaka, Japan

[73] Assignee: Daikin Industries, Ltd., Japan

[21] Appl. No.: 454,276

[22] PCT Filed: Oct. 25, 1994

[86] PCT No.: PCT/JP94/01784

§ 371 Date: Jun. 15, 1995

§ 102(e) Date: Jun. 15, 1995

[87] PCT Pub. No.: WO95/12098

PCT Pub. Date: May 4, 1995

[30] Foreign Application Priority Data

Oct. 29, 1993 [JP] Japan ..... 5-272011

[51] Int. Cl.[6] ..... F24F 11/02; F25B 47/02

[52] U.S. Cl. ..... 62/151; 62/156; 62/278

[58] Field of Search ..... 62/151, 278, 277, 62/156, 509, 81, 234, 155, 174, 180, 160

[56] References Cited

U.S. PATENT DOCUMENTS 4,688,392 8/1987 Fujimoto et al. ..... 62/278 X 4,901,534 2/1990 Nakatsuno et al. ..... 62/155 X 4,979,371 12/1990 Larson ..... 62/278 X

FOREIGN PATENT DOCUMENTS 565954 6/1954 Japan .

61-114042 5/1986 Japan .

4-194539 7/1992 Japan .

4-350480 12/1992 Japan .

*Primary Examiner*—Harry B. Tanner

*Attorney, Agent, or Firm*—Sixbey, Friedman, Leedom & Ferguson, P.C.; Gerald J. Ferguson, Jr.; Tim L. Brackett, Jr.

[57] ABSTRACT

When a defrosting requiring signal is outputted, the opening of a motor-operated expansion valve (5) is fully closed in a heating cycle so that refrigerant is recovered into a receiver (4). In addition, when the defrosting requiring signal is outputted, an indoor fan (6f) is deactivated so that heat is stored. Further, when the completion of the recovery of refrigerant is determined, defrosting operation is executed. The recovery of refrigerant is completed when an outdoor heat-exchange temperature Tc at the present time drops to or below a specified temperature, when the outdoor heat-exchange temperature Tc at the present time drops to or more than a specified difference from a reference outdoor heat-exchange temperature Tcl at the time before the motor-operated expansion valve (5) is fully closed, when an indoor heat-exchange temperature Te at the present time rises to or above a specified temperature, or when a set time passes.

8 Claims, 3 Drawing Sheets

OPERATION CONTROL DEVICE FOR AIR CONDITIONER

[TECHNICAL FIELD]

This invention relates to an operation control device for air conditioner, and particularly relates to measures for controlling the start of defrosting operation.

[BACKGROUND ART]

There is a conventional air conditioner in which a compressor, a four-way selector valve, a thermal-source-side heat exchanger, an expansion valve for heating provided together with a non-return valve, an expansion valve for cooling provided together with a non-return valve, and a used-side heat exchanger are sequentially connected, as disclosed in the Japanese Patent Application Laid-Open Gazette No.61-114042. This air conditioner performs defrosting operation when a fin of the thermal-source-side heat exchanger is frosted in heating operation.

Further, before starting the defrosting operation, the air conditioner deactivates a used-side fan and performs heat storage in the used-side heat exchanger with high-pressure refrigerant. Then, with the refrigerant thus heated, the air conditioner performs the defrosting operation in a cooling cycle so as to complete it with efficiency for a short time.

Problems to be solved

In the above control of defrosting operation, however, since the heat storage is executed only with the used-side fan deactivated before the start of defrosting operation and the expansion valves are fully opened, the defrosting operation is started with liquid refrigerant stored in the thermal-source-side heat exchanger. Thus, an amount of heat of condensation is not only used for dissolving frost but also dissipated into low-temperature refrigerant such as liquid refrigerant.

As a result, not only the amount of heat of condensation is not effectively used for dissolving frost but also a part of the thermal-source-side heat exchanger in which liquid refrigerant is stored is not used as an area for condensation of gas refrigerant, thereby presenting the problems of low defrosting performance and long-time defrosting operation.

In view of the foregoing problems this invention has been made. An object of this invention is to use the amount of heat of condensation of refrigerant only for dissolution of frost while increasing an area for condensation of refrigerant, thereby enhancing defrosting performance and reducing a defrosting time.

[DISCLOSURE OF INVENTION]

To achieve the above object, measures instituted in this invention are so composed as to fully close an expansion mechanism before defrosting operation is executed.

Constitution

More specifically, as shown in FIG. 1, a measure instituted in the invention premises an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation.

Further, there is provided defrosting requiring means (11) for outputting a defrosting requiring signal to require defrosting operation.

Furthermore, there is provided refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant.

In addition, there are provided completion determining means (14) for determining whether the recovery of refrigerant by the refrigerant recovering means (12) is completed and defrosting executing means (15) for executing defrosting operation when the completion determining means (14) outputs a completion signal that the recovery of refrigerant is completed.

A measure instituted in the invention further comprises heat-storage operating means (13) for deactivating the used-side fan (6*f*) when the defrosting requiring means (11) outputs a defrosting requiring signal, thereby implementing heat storage in the used-side heat exchanger.

A measure instituted in the invention is so composed that the refrigerant circuit (9) is reversibly operable between cooling cycle operation and heating cycle operation and the defrosting executing means (15) executes defrosting operation in the reverse cycle.

A measure instituted in the invention is so composed that a high-pressure liquid line of the refrigerant circuit (9) is provided with a receiver (4) for storing liquid refrigerant.

A measure instituted in the invention is so composed that the completion determining means (14) receives a sensed temperature signal from thermal-source-side temperature sensing means (Thc) for sensing a refrigerant temperature Tc of the thermal-source-side heat exchanger (3) and outputs a completion signal when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed.

A measure instituted in the invention is so composed that the completion determining means (14) receives a sensed temperature signal from thermal-source-side temperature sensing means (Thc) for sensing a refrigerant temperature Tc of the thermal-source-side heat exchanger (3) and outputs a completion signal when the refrigerant temperature Tc of the thermal-source-side heat exchanger (3) drops to or below a specified temperature.

A measure instituted in the invention is so composed that the completion determining means (14) receives a sensed temperature signal from used-side temperature sensing means (The) for sensing a refrigerant temperature Te of the used-side heat exchanger (6) and outputs a completion signal when the refrigerant temperature Te of the used-side heat exchanger (6) rises to or above a specified temperature.

A measure instituted in the invention is so composed that the completion determining means (14) receives respective sensed temperature signals from thermal-source-side temperature sensing means (Thc) for sensing a refrigerant temperature Tc of the thermal-source-side heat exchanger (3) and from used-side temperature sensing means (The) for sensing a refrigerant temperature Te of the used-side heat exchanger (6) and a time signal from timer means (TM), and outputs a completion signal when the refrigerant temperature Tc of the thermal-source-side heat exchanger (3) at the present time drops to or below a specified temperature, when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed, when the refrigerant temperature Te of the used-side heat exchanger (6) at the present time rises to or above a specified temperature, or when a set time passes.

Operations

Under the above structure, for example, the defrosting requiring means (11) first divides the sum of heating performance by the period of time that a heating operation period after the end of defrosting operation and a defrosting operation period to be preliminary expected are added to calculate a mean value of heating performance, and outputs a defrosting requiring signal when the mean value of heating performance is below the last-time mean value of heating performance.

When the defrosting requiring signal is outputted, the refrigerant recovering means (12) starts to fully close the expansion mechanism (5) thereby recovering liquid refrigerant stored in the thermal-source-side heat exchanger (3). Particularly, the liquid refrigerant is recovered into the receiver (4). Further, the heat-storage operating means (13) deactivates the used-side fan (6*f*) thereby implements heat storage in the thermal-source-side heat exchanger (3) with high-pressure refrigerant.

The completion of the above recovery of refrigerant and heat storage is determined by the completion determining means (14). More specifically, the completion determining means (14) outputs a completion signal when a refrigerant temperature Tc of the thermal-source-side heat exchanger (3) at the present time drops to or more than a specified difference from a reference refrigerant temperature Tcl of the thermal-source-side heat exchanger (3) at the time before the heat storage is started. The completion determining means (14) outputs a completion signal when the refrigerant temperature Tc of the thermal-source-side heat exchanger (3) drops to or below a specified temperature. The completion determining means (14) outputs a completion signal when a refrigerant temperature Te of the used-side heat exchanger (6) rises to or above a specified temperature. The completion determining means (14) outputs a completion signal when a set time passes or when any one of several conditions is met.

Based on the completion signal, the defrosting executing means (15) starts defrosting operation. Particularly, the defrosting executing means (15) executes defrosting operation in the reverse cycle thereby dissolving frost.

Effects

As described above, since the expansion mechanism (5) is fully closed before defrosting operation is executed, cold refrigerant such as liquid refrigerant stored in the thermal-source-side heat exchanger (3) is recovered and then the defrosting operation is started. Accordingly, not only an amount of heat of condensation can be used only for dissolving frost, but also the whole area of the outdoor heat exchanger can be used as an area for condensation of gas refrigerant.

As a result, defrosting performance can be enhanced and a defrosting time can be reduced.

Since heat is stored in the used-side heat exchanger (6) and refrigerant before defrosting operation is executed, dissolution of frost can be realized with the use of an amount of heat thus stored, thereby further enhancing defrosting performance and reducing the defrosting time.

Since defrosting operation is executed in the reverse cycle, the defrosting operation can be realized speedily and efficiently as compared with defrosting operation in the normal cycle.

Since the refrigerant circuit (9) is provided with the receiver (4), refrigerant can be securely recovered into the receiver (4), thereby securely enhancing defrosting performance and reducing the defrosting time.

Since the recovery of refrigerant or the like is completed when the present refrigerant temperature Tc of the thermal-source-side heat exchanger (3) drops to or more than a specified difference from the reference refrigerant temperature Tcl of the thermal-source-side heat exchanger (3), the recovery of refrigerant or the like can be completed for a short time, thereby speedily executing the defrosting operation. Further, though the determination based on only the refrigerant temperature Tc invites excessive drop in pressure of low-pressure refrigerant, this excessive drop in pressure of low-pressure refrigerant can be prevented thereby enhancing reliability of the compressor (1).

Since the recovery of refrigerant or the like is completed when the refrigerant temperature Tc of the thermal-source-side heat exchanger (3) drops to or below a specified temperature, excessive drop in pressure of low-pressure refrigerant can be prevented.

Since the recovery of refrigerant or the like is completed when the refrigerant temperature Te of the used-side heat exchanger (6) rises to or above a specified temperature, excessive rise in pressure of high-pressure refrigerant can be securely prevented.

[BEST MODE FOR CARRYING OUT THE INVENTION]

Detailed description is made below about an embodiment of this invention with reference to the drawings.

Figure 1:
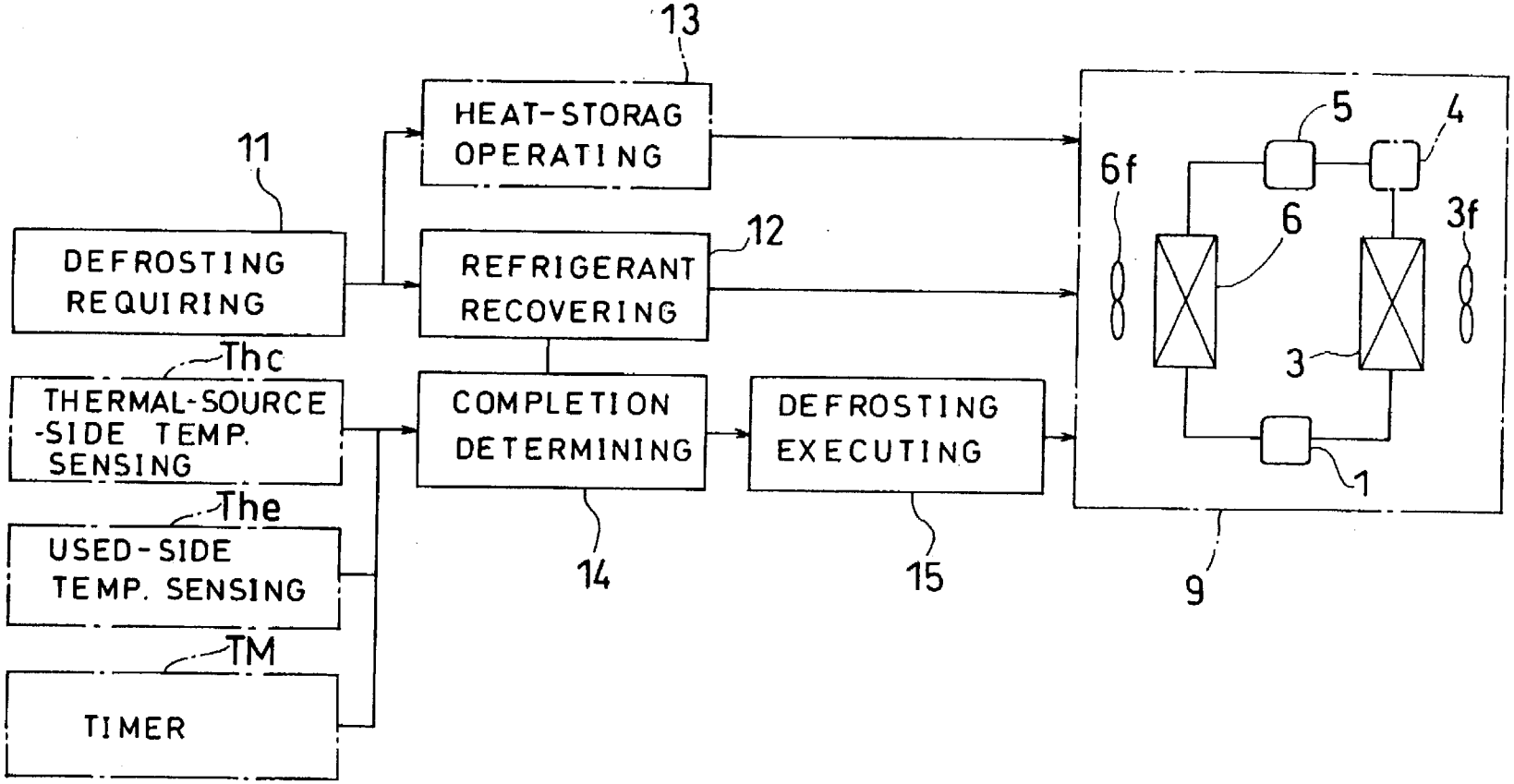
FIG. 1 is a block diagram showing the structure of the present invention.
Figure 2:
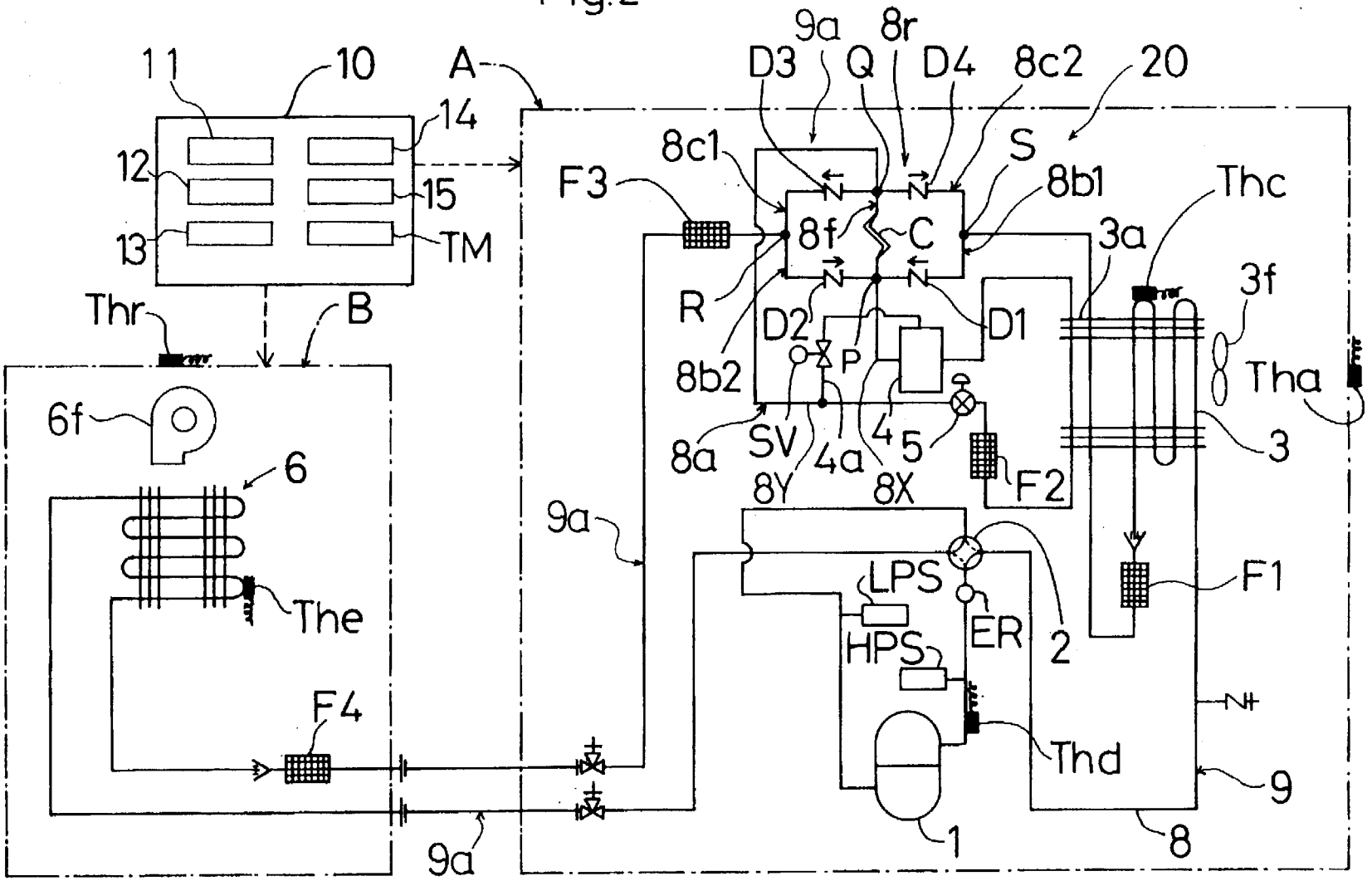
FIG. 2 is a refrigerant circuit diagram showing an embodiment of the invention.

FIG. 2 shows a refrigerant piping system of an air conditioner applying this invention, which is a so-called separate type one in which a single indoor unit (B) is connected to a single outdoor unit (A).

The outdoor unit (A) comprises a compressor (1) of scroll type to be variably adjusted in operational frequency by an inverter, a four-way selector valve (2) switchable as shown in a solid line of FIG. 2 in cooling operation and in a broken line of FIG. 2 in heating operation, an outdoor heat exchanger (3) as a thermal-source-side heat exchanger which functions as a condenser in cooling operation and as an evaporator in heating operation, and a pressure reduction part (20) for reducing refrigerant in pressure. The outdoor heat exchanger (3) is provided with an outdoor fan (3*f*) as a thermal-source-side fan.

In the indoor unit (B), there is disposed an indoor heat exchanger (6) as a used-side heat exchanger which functions as an evaporator in cooling operation and as a condenser in heating operation. The indoor heat exchanger (6) is provided with an indoor fan (6*f*) as a used-side fan.

The compressor (1), the four-way selector valve (2), the outdoor heat exchanger (3), the pressure reduction part (20) and the indoor heat exchanger (6) are sequentially connected through refrigerant piping (8), thereby forming a refrigerant circuit (9) in which circulation of refrigerant causes heat transfer.

The pressure reduction part (20) includes a bridge-like rectification circuit (8*r*) and a common passage (8*a*) connected to a pair of connection points (P, Q) of the rectification circuit (8*r*). In the common passage (8*a*), there are arranged in series a receiver (4), which is placed in an upstream-side common passage (8X) serving as a high-pressure liquid line at any time, for storing liquid refrigerant, an auxiliary heat exchanger (3*a*) for outdoor heat exchanger (3), and a motor-operated expansion valve (5) freely adjustable in opening, which serves as an expansion mechanism having a function of reducing liquid refrigerant in pressure and a function of adjusting a flow rate of liquid refrigerant. Another pair of connection points (R, S) of the rectification circuit (8*r*) are connected to the indoor heat exchanger (6) side of the refrigerant piping (8) and the outdoor heat exchanger (3) side of the refrigerant piping (8) respectively. There is formed a main line (9*a*) in which the compressor (1), the four-way selector valve (2), the outdoor heat exchanger (3), the rectification circuit (8*r*) and the common passage (8*a*) are sequentially connected and the rectification circuit (8*r*), the indoor heat exchanger (6), the four-way selector valve (2) and the compressor (1) are sequentially connected.

Further, the rectification circuit (8*r*) is provided with: a first inflow passage (8*b*1) which connects the up-stream-side connection point (P) of the common passage (8*a*) to the connection point (S) on the outdoor heat exchanger (3) side and has a first non-return valve (D1) for allowing refrigerant to flow only in a direction from the outdoor heat exchanger (3) to the receiver (4); a second inflow passage (8*b*2) which connects the upstream-side connection point (P) of the common passage (8*a*) to the connection point (R) on the indoor heat exchanger (6) side and has a second non-return valve (D2) for allowing refrigerant to flow only in a direction from the indoor heat exchanger (6) to the receiver (4); a first discharge passage (8*c*1) which connects the downstream-side connection point (Q) of the common passage (8*a*) to the connection point (R) on the indoor heat exchanger (6) side and has a third non-return valve (D3) for allowing refrigerant to flow only in a direction from the motor-operated expansion valve (5) to the indoor heat exchanger (6); and a second discharge passage (8*c*2) which connects the downstream-side connection point (Q) of the common passage (8*a*) to the connection point (S) on the outdoor heat exchanger (3) side and has a fourth non-return valve (D4) for allowing refrigerant to flow only in a direction from the motor-operated expansion valve (5) to the outdoor heat exchanger (3).

Between both the connection points (P, Q) of the common passage (8*a*) of the rectification circuit (8*r*), a liquid seal preventing bypass passage (8*f*) provided with a capillary tube (C) is formed. The liquid seal preventing bypass passage (8*f*) prevents liquid seal at the deactivation of the compressor (1). Further, between the upper part of the receiver (4) and a part of the downstream-side common passage (8Y) which is located on a downstream side of the motor-operated expansion valve (5) and serves as a low-pressure liquid line at any time, there is provided an open/shut-off valve (SV) as open/shut-off means connected to a bypass passage (4*a*) for bypassing the motor-operated expansion valve (5), thereby venting gas refrigerant stored in the receiver (4).

The degree of pressure reduction of the capillary tube (C) is set at a sufficiently larger value than the motor-operated expansion valve (5) so that the motor-operated expansion valve (5) adequately maintains the function of adjusting a flow rate of refrigerant in normal operation.

(F1 to F4) indicate filters for removing dusts from refrigerant, and (ER) indicates a silencer for reducing operational sound of the compressor (1).

The air conditioner is provided with various sensors. (Thd) is a discharge pipe sensor, which is disposed in a discharge pipe of the compressor (1), for sensing a discharge-pipe temperature Td. (Tha) is an outdoor inlet sensor, which is disposed in an air inlet of the outdoor unit (A), for sensing an outdoor-air temperature Ta as an open-air temperature. (Thc) is an outdoor heat-exchange sensor, which is disposed in the outdoor heat exchanger (3), for sensing an outdoor heat-exchange temperature Tc as a condensation temperature in cooling operation and as an evaporation temperature in heating operation. (Thr) is an indoor inlet sensor, which is disposed in an air inlet of the indoor unit (B), for sensing an indoor-air temperature Tr as a room temperature. (The) is an indoor heat-exchange sensor, which is disposed in the indoor heat exchanger (6), for sensing an indoor heat-exchange temperature Te as an evaporation temperature in cooling operation and as a condensation temperature in heating operation. (HPS) is a high-pressure-control pressure switch for sensing a pressure of high-pressure refrigerant and turning on at the excessive rise in pressure of high-pressure refrigerant to output a high-pressure signal. (LPS) is a low-pressure-control pressure switch for sensing a pressure of low-pressure refrigerant and turning on at the excessive drop in pressure of low-pressure refrigerant to output a low-pressure signal.

Respective output signal of the sensors (Thd to The) and the switches (HPS, LPS) are inputted into a controller (10). The controller (10) is so composed as to control air conditioning according to the input signals.

In the above-mentioned refrigerant circuit (9), circulation of refrigerant in cooling operation is made in the following manner. Refrigerant is condensed in the outdoor heat exchanger (3) so as to be liquefied. Liquid refrigerant thus liquefied flows through the first non-return valve (D1) from the first inflow passage (8*b*1), is then stored in the receiver (4), is reduced in pressure by the motor-operated expansion valve (5), flows through the first discharge passage (8*c*1). and is evaporated in the indoor heat exchanger (6). Refrigerant thus evaporated returns to the compressor (1). On the other hand, circulation of refrigerant in heating operation is made in the following manner. Refrigerant is condensed in the indoor heat exchanger (6) so as to liquefied. Liquid refrigerant thus liquefied flows through the second non-return valve (D2) from the second inflow passage (8*b*2), is then stored in the receiver (4), is reduced in pressure by the motor-operated expansion valve (5), flows through the second discharge passage (8*c*2), and is evaporated in the outdoor heat exchanger (3). Refrigerant thus evaporated returns to the compressor (1).

The controller (10) sections an operational frequency of the inverter into 20 steps N from zero to the maximum frequency, controls the capacity of the compressor (1) by finding out each frequency step N so that the discharge-pipe temperature Td becomes an optimum discharge-pipe temperature, and controls the opening of the motor-operated expansion valve (5) so that the discharge-pipe temperature Td becomes an optimum discharge-pipe temperature.

The controller (10) has, as a feature of this invention, a defrosting requiring means (11), a refrigerant recovering means (12), a heat-storage operating means (13), a completion determining means (14) and a defrosting executing means (15).

The defrosting requiring means (11) is so composed as to output a defrosting requiring signal when the refrigerant circuit (9) becomes specified conditions. For example, the defrosting requiring means (11) memorizes the sum of heating performance from the start of heating operation after the end of defrosting operation, divides the sum of heating performance by the period of time that a heating operation period after the end of defrosting operation and a defrosting operation period to be preliminary expected are added to calculate a mean value of heating performance, and outputs a defrosting requiring signal when the mean value of heating performance is below the last-time mean value of heating performance.

The refrigerant recovering means (12) is so composed as to fully close the opening of the motor-operated expansion valve (5) with the refrigerant circuit (9) in a heating cycle when the defrosting requiring means (11) outputs a defrosting requiring signal, thereby recovering refrigerant into the receiver (4).

The heat-storage operating means (13) is so composed as to deactivate the indoor fan (6*f*) when the defrosting requiring means (11) outputs a defrosting requiring signal, thereby implementing heat storage in the indoor heat exchanger with high-pressure refrigerant.

The completion determining means (14) is so composed as to determine whether the refrigerant recovering means (12) completes the recovery of refrigerant and whether the heat-storage operating means (13) completes the heat storage. More specifically, the completion determining means (14) receives respective sensed temperature signal from the outdoor heat-exchange sensor (Thc) and the indoor heat-exchange sensor (The), receives a time signal from a timer means (TM) which starts when the defrosting requiring means (11) outputs a defrosting requiring signal, and outputs a completion signal in any one of the following cases that:

① the present outdoor heat-exchange temperature Tc drops to or below a specified temperature, e.g., −30° C.;

② the present outdoor heat-exchange temperature Tc drops to or more than a specified difference, e.g., 4° C., from the reference outdoor heat-exchange temperature Tcl at the time before the motor-operated expansion valve (5) is fully closed;

③ the present indoor heat-exchange temperature Te rises to or above a specified temperature, e.g., 35° C.; and ④ a set time passes, e.g., 10 seconds passes after the indoor fan (6*f*) is deactivated.

The defrosting executing means (15) is so composed as to control the opening and closing of the motor-operated expansion valve (5) and the open/shut-off valve (SV) when the completion determining means (14) outputs a completion signal and to execute defrosting operation in the reverse cycle. Further, the defrosting executing means (15) completes the defrosting operation in any one of the case that the frequency step N of the compressor (1) drops to 6, the case that the discharge-pipe temperature Td drops below 110° C. and the case that the defrosting operation period becomes longer than 10 minutes.

Defrosting operation

Figure 3:
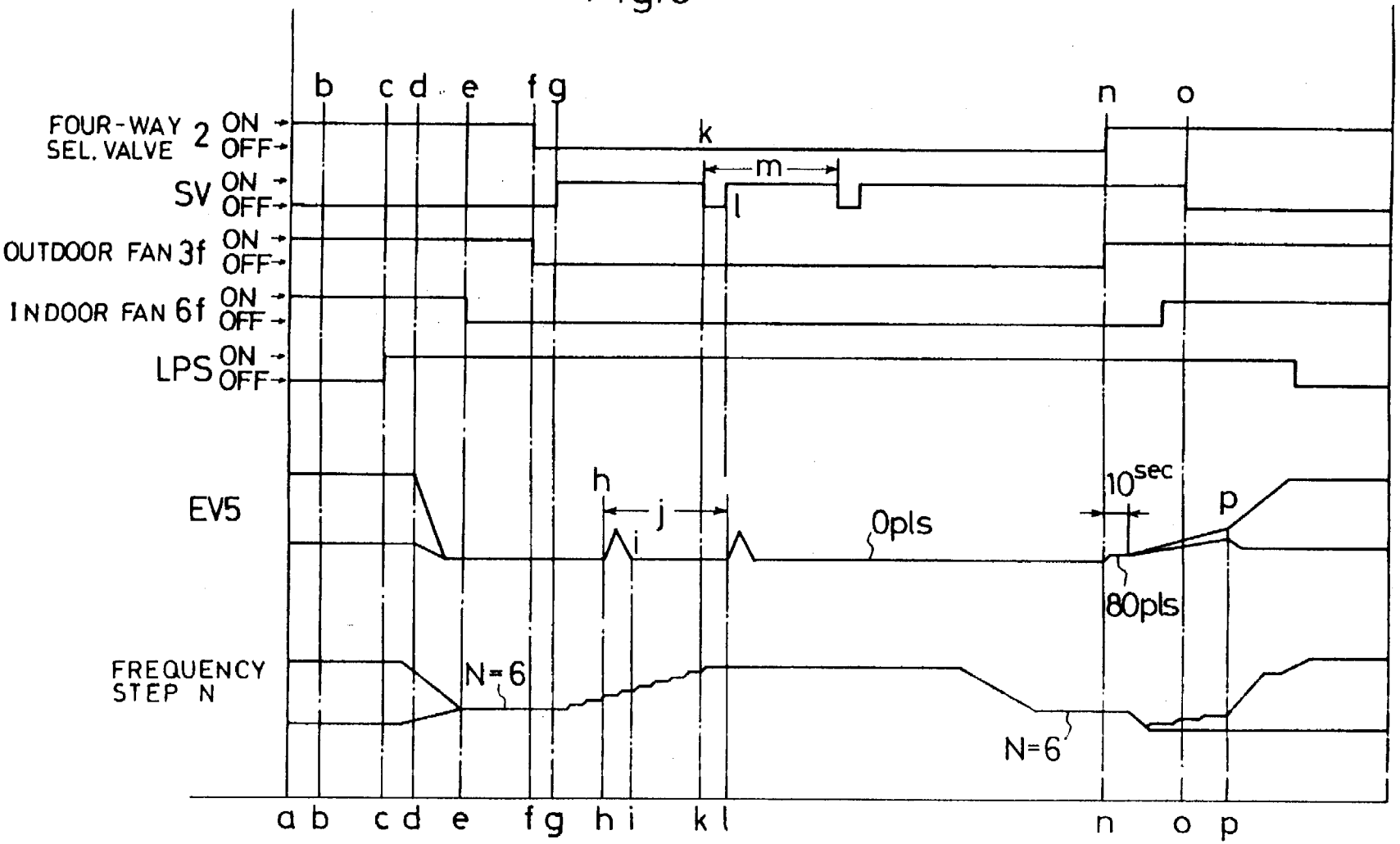
FIG. 3 is a timing chart showing the control of defrosting operation.

Next, description is made about controls of defrosting operation of the air conditioner above-mentioned, with reference to a timing chart of FIG. 3.

First, in heating cycle operation, the four-way selector valve (2) is turned to an ON state as shown from a point a to point b, that is, switched to the broken line shown in FIG. 2, to fuzzy-control the opening of the motor-operated expansion valve (5) and the frequency step N of the compressor (1) so as to be an optimum discharge-pipe temperature, thereby performing heating operation.

At the point b, the defrosting requiring means (11) divides the sum of heating performance by the period of time that a heating operation period after the end of defrosting operation and a defrosting operation period to be preliminary expected are added to calculate a mean value of heating performance, and outputs a defrosting requiring signal when the mean value of heating performance is below the last-time mean value of heating performance. When the defrosting requiring signal is outputted, defrosting operation waits until preparation of defrosting operation in the indoor unit (B) is completed at a point c, e.g., until treatment on a heater or the like is completed, the low-pressure-control pressure switch (LPS) is masked and then defrosting operation further waits for 35 seconds to a point d, i.e., to the time that the frequency step N of the compressor (1) to switch the four-way selector valve (2), which is 6, comes.

Thereafter, as a feature of this invention, the refrigerant recovering means (12) starts from the point d fully closing operation for making the opening of the motor-operated expansion valve (5) into 0 pulse, thereby recovering liquid refrigerant stored in the outdoor heat exchanger (3) into the receiver (4).

When the time sufficient for fully closing the motor-operated expansion valve (5) has passed, as another feature of this invention, the heat-storage operating means (13) deactivates the indoor fan (6*f*) at a point e, thereby implementing heat storage in the indoor heat exchanger (6) with high-pressure refrigerant.

The completion determining means (14) determines that the refrigerant recovery and heat storage operation is completed when the operation has been executed for at most 10 seconds, when the indoor heat-exchange temperature Te rises above 35° C., when the outdoor heat-exchange temperature Tc drops below −30° C., or when the present outdoor heat-exchange temperature Tc drops 4° C. more than the reference outdoor heat-exchange temperature Tcl (more specifically, the temperature at the point d) at the time before the heat storage is started (See a point f).

In detail, the completion of the above operation when the indoor heat-exchange temperature Te rises above 35° C. is for preventing high-pressure refrigerant from increasing in pressure. The reason for the completion of the above operation when the outdoor heat-exchange temperature Tc drops below −35° C. is that low-pressure refrigerant is decreased in pressure so that an amount of refrigerant becomes smaller thereby eliminating the need for recovering refrigerant. The reason for the completion of the above operation when the difference between Tc and Tcl exceeds 4° C. is that it is considered that a certain amount of refrigerant has been already recovered.

Then, at this point f, the defrosting executing means (15) deactivates the outdoor fan (3*f*), switches the four-way selector valve (2), i.e., switches according to the defrosting requiring signal the four-way selector valve (2) as shown in the solid line of FIG. 2 to set it to a cooling cycle, and feeds to the outdoor heat exchanger (3) high-temperature refrigerant discharged from the compressor (1) to start defrosting operation in the reverse cycle.

When the defrosting operation is started, the defrosting executing means (15) holds the motor-operated expansion valve (5) in the fully closed state of 0 pulse and also closes the open/shut-off valve (SV), thereby shutting off both the common passage (8*a*) and the bypass passage (4*a*). In detail, the switching of the four-way selector valve (2) reverses the pressure distribution of refrigerant in the refrigerant circuit (9) to prevent liquid refrigerant of high-temperature and high-pressure from flowing into the outdoor heat exchanger (3) and the indoor heat exchanger (6) from the receiver (4).

Thereafter, when 15 seconds has passed, the defrosting executing means (15) opens the open/shut-off valve (SV) at a point g and gradually increases the operational frequency N of the compressor (1), so that refrigerant discharged from the compressor (1) is condensed in the outdoor heat exchanger (3) to dissolve frost and flows into the receiver (4). From the receiver (4), gas refrigerant flows into the indoor heat exchanger (6) via the bypass passage (4*a*) and returns to the compressor (1). By such circulation of refrigerant, defrosting operation is executed.

Subsequently, when the discharge-pipe temperature Td rises above 90° C. in the defrosting operation, between a point h and a point i the defrosting executing means (15) outputs respective signals for opening and closing the motor-operated expansion valve (5) to once open the motor-operated expansion valve (5) to 200 pulses and then close it. In detail, liquid refrigerant is introduced into the indoor heat exchanger (6) from the receiver (4), thereby preventing operation in superheated condition of the compressor (1). The opening/closing operation of the motor-operated expansion valve (5) is executed a single time in every one minute as shown in a term j, in order to prohibit the excessive opening/closing operation.

On the other hand, when the discharge-pipe temperature Td drops below 85° C. in the defrosting operation, between a point k and a point l the wet condition control means (13) outputs a closing signal for the open/shut-off valve (SV) to hold the open/shut-off valve (SV) closed for 20 seconds. In detail, the wet condition control means (13) shuts off both the common passage (8*a*) and the bypass passage (4*a*) to prevent liquid refrigerant from turning back, thereby preventing operation in wet condition of the compressor (1). The closing operation of the open/shut-off valve (SV) is executed a single time in every 50 seconds as shown in a term m, in order to prohibit the excessive closing operation.

Thereafter, in any one of the case that the frequency step N of the compressor (1) drops to 6, the case that the discharge-pipe temperature Td rises above 110° C., and the case that the defrosting operation period becomes longer than 10 minutes, as shown in a point n, the defrosting executing means (15) completes defrosting operation, turns the four-way selector valve (2) to an ON state to switch it as shown in the broken line of FIG. 2 and activates the outdoor fan (3*f*), thereby starting heating operation in a hot start. At the time just before the defrosting operation is completed, the frequency step N of the compressor (1) is set to become 6 without exception according to the timer or the discharge-pipe temperature Td.

Then, when the defrosting operation is completed, between a point n and a point o the open/shut-off valve (SV) is opened for 2 minutes and then closed to prevent the short of refrigerant, while between the point n and a point p the motor-operated expansion valve (5) is gradually opened to prevent the operation in wet condition. Then, the opening of the motor-operated expansion valve (5) and the frequency step N of the compressor (1) are fuzzy-controlled so as to provide the optimum discharge-pipe temperature, thereby restarting normal heating operation.

Characteristic Effects of the Embodiment

According to the present embodiment, since the expansion mechanism (5) is fully closed before defrosting operation is executed, cold refrigerant such as liquid refrigerant stored in the indoor heat exchanger (3) is recovered and then the defrosting operation is started. Accordingly, an amount of heat of condensation can be used only for dissolving frost and the whole area of the outdoor heat exchanger (3) can be used as an area for condensation of gas refrigerant.

As a result, defrosting performance can be enhanced and a defrosting time can be reduced.

Further, since heat is stored in the indoor heat exchanger (6) and refrigerant before defrosting operation is executed, dissolution of frost can be realized with the use of an amount of heat thus stored, thereby further enhancing defrosting performance and reducing the defrosting time.

Furthermore, since defrosting operation is executed in the reverse cycle, the defrosting operation can be realized speedily and efficiently as compared with defrosting operation in the normal cycle.

Moreover, since the refrigerant circuit (9) is provided with the receiver (4), refrigerant can be securely recovered into the receiver (4), thereby securely enhancing defrosting performance and reducing the defrosting time.

Further, since the recovery of refrigerant or the like is completed when the present outdoor heat-exchange temperature Tc drops 4° C. more than the reference outdoor heat-exchange temperature Tcl, the recovery of refrigerant or the like can be completed for a short time, thereby speedily executing the defrosting operation. Furthermore, though the determination based on only the outdoor heat-exchange temperature Tc invites excessive drop in pressure of low-pressure refrigerant, this excessive drop in pressure of low-pressure refrigerant can be prevented thereby enhancing reliability of the compressor (1).

Further, since the recovery of refrigerant or the like is completed when the outdoor heat-exchange temperature Tc drops below −30° C., excessive drop in pressure of low-pressure refrigerant can be prevented.

Furthermore, since the recovery of refrigerant or the like is completed when the indoor heat-exchange temperature Te rises above 35° C., excessive rise in pressure of high-pressure refrigerant can be securely prevented.

Other Modifications

In the above embodiments, the open/shut-off valve (SV), the motor-operated expansion valve (5) and the like are opened and closed in defrosting operation. However, defrosting operation in this invention is not limited to such operation.

Further, it is a matter of course that the heat-storage operation may not necessarily be executed.

Furthermore, the refrigerant circuit (9) is not limited to the above embodiment. For example, it may be a refrigerant circuit having no rectification circuit (8*r*).

[INDUSTRIAL APPLICABILITY]

As described so far, an operation control device for air conditioner of this invention is useful for air conditioners performing heating operation and particularly displays the effects for air conditioners performing defrosting operation.

We claim:

1. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

completion determining means (14) for determining whether the recovery of refrigerant by the refrigerant recovering means (12) is completed;

defrosting executing means (15) for executing defrosting operation when the completion determining means (14) outputs a completion signal that the recovery of refrigerant is completed; and thermal-source-side temperature sensing means (Thc) for sensing a refrigerant temperature Tc of the thermal-source-side heat exchanger (3), wherein the completion determining means (14) receives a sensed temperature signal from the thermal-source-side temperature sensing means (Thc) and outputs a completion signal when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed.

2. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

heat-storage operating means (13) for deactivating the used-side fan (6*f*) when the defrosting requiring means (11) outputs a defrosting requiring signal, thereby implementing heat storage;

completion determining means (14) for determining whether the recovery of refrigerant by the refrigerant recovering means (12) is completed and whether the heat storage by the heat-storage operating means (13) is completed;

defrosting executing means (15) for executing defrosting operation when the completion determining means (14) outputs a completion signal that the recovery of refrigerant is completed; and thermal-source-side temperature sensing means (Thc) for sensing a refrigerant temperature Tc of the thermal-source-side heat exchanger (3), wherein the completion determining means (14) receives a sensed temperature signal from the thermal-source-side temperature sensing means (Thc) and outputs a completion signal when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed.

3. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

completion determining means (14) for determining whether the recovery of refrigerant by the refrigerant recovering means (12) is completed;

defrosting executing means (15) for executing defrosting operation when the completion determining means (14) outputs a completion signal that the recovery of refrigerant is completed; and thermal-source-side temperature sensing means (Thc) for sensing a refrigerant temperature Tc of the thermal-source-side heat exchanger (3), wherein the completion determining means (14) receives a sensed temperature signal from the thermal-source-side temperature sensing means (Thc) and outputs a completion signal when the refrigerant temperature Tc of the thermal-source-side heat exchanger (3) drops to or below a specified temperature.

4. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

heat-storage operating means (13) for deactivating the used-side fan (6*f*) when the defrosting requiring means (11) outputs a defrosting requiring signal, thereby implementing heat storage;

completion determining means (14) for determining whether the recovery of refrigerant by the refrigerant recovering means (12) is completed and whether the heat storage by the heat-storage operating means (13) is completed;

defrosting executing means (15) for executing defrosting operation when the completion determining means (14) outputs a completion signal that the recovery of refrigerant is completed; and thermal-source-side temperature sensing means (Thc) for sensing a refrigerant temperature Tc of the thermal-source-side heat exchanger (3), wherein the completion determining means (14) receives a sensed temperature signal from the thermal-source-side temperature sensing means (Thc) and outputs a completion signal when the refrigerant temperature Tc of the thermal-source-side heat exchanger (3) drops to or below a specified temperature.

5. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

completion determining means (14) for determining whether the recovery of refrigerant by the refrigerant recovering means (12) is completed;

defrosting executing means (15) for executing defrosting operation when the completion determining means (14) outputs a completion signal that the recovery of refrigerant is completed; and used-side temperature sensing means (The) for sensing a refrigerant temperature Te of the used-side heat exchanger (6), wherein the completion determining means (14) receives a sensed temperature signal from the used-side temperature sensing means (The) and outputs a completion signal when the refrigerant temperature Te of the used-side heat exchanger (6) rises to or above a specified temperature.

6. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

heat-storage operating means (13) for deactivating the used-side fan (6*f*) when the defrosting requiring means (11) outputs a defrosting requiring signal, thereby implementing heat storage;

completion determining means (14) for determining whether the recovery of refrigerant by the refrigerant recovering means (12) is completed and whether the heat storage by the heat-storage operating means (13) is completed;

defrosting executing means (15) for executing defrosting operation when the completion determining means (14) outputs a completion signal that the recovery of refrigerant is completed; and used-side temperature sensing means (The) for sensing a refrigerant temperature Te of the used-side heat exchanger (6), wherein the completion determining means (14) receives a sensed temperature signal from the used-side temperature sensing means (The) and outputs a completion signal when the refrigerant temperature Te of the used-side heat exchanger (6) rises to or above a specified temperature.

7. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

completion determining means (14) for determining whether the recovery of refrigerant by the refrigerant recovering means (12) is completed;

defrosting executing means (15) for executing defrosting operation when the completion determining means (14) outputs a completion signal that the recovery of refrigerant is completed; and thermal-source-side temperature sensing means (Thc) for sensing a refrigerant temperature Tc of the thermal-source-side heat exchanger (3);

used-side temperature sensing means (The) for sensing a refrigerant temperature Te of the used-side heat exchanger (6);

timer means (TM) which starts when the defrosting requiring means (11) outputs a defrosting requiring signal; and the completion determining means (14) receives respective sensed temperature signal from the thermal-source-side temperature sensing means (Thc) and from the used-side temperature sensing means (The) and a time signal from the timer means (TM), and outputs a completion signal when the refrigerant temperature Tc of the thermal-source-side heat exchanger (3) at the present time drops to or below a specified temperature, when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed, when the refrigerant temperature Te of the used-side heat exchanger (6) at the present time rises to or above a specified temperature, or when a set time passes.

8. In an air conditioner comprising a refrigerant circuit (9) in which a compressor (1), a thermal-source-side heat exchanger (3) having a thermal-source-side fan (3*f*), an expansion mechanism (5) freely adjustable in opening and a used-side heat exchanger (6) having a used-side fan (6*f*) are sequentially connected and which is operable in at least heating cycle operation, an operation control device for said air conditioner comprising:

defrosting requiring means (11) for outputting a defrosting requiring signal to require defrosting operation;

refrigerant recovering means (12) for fully closing the opening of the expansion mechanism (5) with the refrigerant circuit (9) in a heating cycle when the defrosting requiring means (11) outputs a defrosting requiring signal, thereby recovering refrigerant;

heat-storage operating means (13) for deactivating the used-side fan (6*f*) when the defrosting requiring means (11) outputs a defrosting requiring signal, thereby implementing heat storage;

completion determining means (14) for determining whether the recovery of refrigerant by the refrigerant recovering means (12) is completed and whether the heat storage by the heat-storage operating means (13) is completed;

defrosting executing means (15) for executing defrosting operation when the completion determining means (14)

outputs a completion signal that the recovery of refrigerant is completed; and thermal-source-side temperature sensing means (Thc) for sensing a refrigerant temperature Tc of the thermal-source-side heat exchanger (3);

used-side temperature sensing means (The) for sensing a refrigerant temperature Te of the used-side heat exchanger (6);

timer means (TM) which starts when the defrosting requiring means (11) outputs a defrosting requiring signal; and the completion determining means (14) receives respective sensed temperature signal from the thermal-source-side temperature sensing means (Thc) and from the used-side temperature sensing means (The) and a time signal from the timer means (TM), and outputs a completion signal when the refrigerant temperature Tc of the thermal-source-side heat exchanger (3) at the present time drops to or below a specified temperature, when the refrigerant temperature Tc of the thermal-source-side heat exchanger (3) at the present time drops to or more than a specified difference from a reference refrigerant temperature Tcl of the thermal-source-side heat exchanger (3) at the time before the expansion mechanism (5) is fully closed, when the refrigerant temperature Te of the used-side heat exchanger (6) at the present time rises to or above a specified temperature, or when a set time passes.

* * * * *